US007255287B2

(12) United States Patent
Cremin

(10) Patent No.: US 7,255,287 B2
(45) Date of Patent: Aug. 14, 2007

(54) CENTRAL HEATING

(76) Inventor: Timothy Cremin, Bealnadeega, Headford, Killarney, Co. Kerry (IE)

( * ) Notice: Subject to any disclaimer, the term of this patent is extended or adjusted under 35 U.S.C. 154(b) by 403 days.

(21) Appl. No.: 10/276,283

(22) PCT Filed: May 11, 2001

(86) PCT No.: PCT/IE01/00064

§ 371 (c)(1),
(2), (4) Date: May 5, 2003

(87) PCT Pub. No.: WO01/86212

PCT Pub. Date: Nov. 15, 2001

(65) Prior Publication Data

US 2003/0168517 A1 Sep. 11, 2003

(30) Foreign Application Priority Data

May 11, 2000 (IE) ..... S2000/0357
Apr. 3, 2001 (IE) ..... S2001/0336

(51) Int. Cl.
*F24D 3/08* (2006.01)

(52) U.S. Cl. ..... 237/16; 237/19

(58) Field of Classification Search ..... 237/16, 237/19, 2 A, 8 B
See application file for complete search history.

(56) References Cited

U.S. PATENT DOCUMENTS 4,479,605 A * 10/1984 Billotte et al. ..... 237/8 R
4,823,770 A * 4/1989 Loeffler ..... 122/15.1
6,202,935 B1 * 3/2001 Akkala et al. ..... 237/19
6,435,420 B1 * 8/2002 Kasai et al. ..... 237/12.1
6,454,179 B1 * 9/2002 Neve et al. ..... 237/2 A
6,612,267 B1 * 9/2003 West ..... 122/13.3
6,622,929 B1 * 9/2003 Levitin et al. ..... 237/16

FOREIGN PATENT DOCUMENTS

BE 515 441 A 11/1952
FR 2 739 177 A 3/1997

* cited by examiner

*Primary Examiner*—Derek S. Boles
(74) *Attorney, Agent, or Firm*—Rossi, Kimms & McDowell LLP

(57) ABSTRACT

An improved central heating reservoir (42) for use with central heating systems of the type having a boiler and a pump. The reservoir (42) is connected in line and has a liquid inlet (43) offset from an associated liquid outlet (44). Offsetting the inlet and outlet dissociates a reduced pressure level at the outlet from an emergency valve (41) allowing the system to operate at higher speeds.

13 Claims, 1 Drawing Sheet

CENTRAL HEATING

The invention relates to central heating and more particularly to an improved central heating system.

The efficiency of such heating systems is limited by the extent to which they are balanced, that is to say the degree to which the liquid returned to the heating element differs in temperature from the liquid dispatched from the heating element or boiler. Operation of the system requires that some heat is lost in heating a particular area, however, optimal operation with minimal fuel consumption requires elimination or minimization of incidental and inertial losses.

A wide variety of systems, fixtures and fittings have been proposed for both domestic and industrial applications to overcome these losses. The effectiveness of known solutions are limited both by the overall size of the system and by the operational speeds of pumps which move the heating liquid around the system. Obviously, the more elements in the system such as radiating heaters and the size of the area to be heated will negatively impact on the temperature of returned heating liquid. These losses are particularly acute during initial operation of the system and are referred to as inertial losses when system elements and the surrounding air are coldest. To overcome these losses it is desirable to operate the circulation pump at a higher speed. Unfortunately, increasing the speed of circulation of the heating fluid results in the ingress of air into the system through emergency release valves as a result of a venturi constriction. Valves mounted on liquid carrying pipes have an effective constriction downstream of the valve and increasing the flow rate reduces the pressure within the pipe to the extent that air is drawn into the system. The ingress of air not only reduces the effectiveness of the system as a whole but can also accelerate corrosion. A wide variety of devices have been developed which attempt to remove air introduced into the system but little has been done to prevent the introduction of air in the first instance. As operation of such systems without safety valves is inconceivable, a well commissioned system is considered to be one that balances the circulation speed requirement with the undesirable introduction of air.

Existing solutions have a number of other problems. For example, in domestic heating systems, where heated water from the central heating circuit is pumped through a coil in a hot water cylinder, there is often a localized increase in pressure. This pressure increase causes unnecessary venting of the heating system, this is generally referred to in the industry as "pitching" and draws air into the system. Unnecessary venting which can draw air into the system can also occur because of localised inaccurate over temperature readings with the same results.

Another limitation becomes apparent when it is desired to alter the original system configuration. For example, if a building extension is constructed, the reconfiguration of existing heating circuits or the provision of further heating circuits is inherently problematic. These problems may result from access restrictions, system capacity limitations or the inability to control additional circuits thus limiting system effectiveness.

There is therefore a need for a central heating system, which will overcome the aforementioned problems.

Accordingly, there is provided a central heating system incorporating a boiler, a pump and an in-line central heating reservoir, the reservoir having a liquid inlet offset from an associated liquid outlet.

Ideally, the reservoir has an associated emergency vent.

By the relatively simple expedient of offsetting the liquid inlet form the liquid outlet the flow of liquid there between is disrupted. As a result, there is no decrease in pressure around the emergency vent when flow rate is increased, as there is no venturi constriction. Thus, circulation speeds can be increased to any practical desired level without drawing additional air into the system thereby reducing inertial losses associated with system operation. Additionally, lesser quality vents can be used thereby reducing system installation costs.

Preferably, the reservoir has one or more heated liquid inlets and one or more cooled liquid outlets.

Ideally, the reservoir has a radiator flow tapping and a radiator return tapping.

Ideally, the reservoir is adaptable for use in conjunction with one or more boilers.

Preferably, the reservoir incorporates means for connection to a plurality of independent or interconnected radiator circuits.

In one arrangement the reservoir incorporates an anti vacuum valve.

Preferably, the reservoir includes a safety release valve to prevent accidental damage to the system.

Preferably, the reservoir also includes an automatic air vent.

The provision of a central heating system reservoir ensures that a larger volume of water is available in the overall system, the temperature throughout is thus balanced and the risk of air being drawn into the system during unnecessary venting caused by inaccurate temperature readings is eliminated. The system reduces water oxygen content throughout the system as air is not drawn in and agitation of water in the system is eliminated. The reservoir also reduces pressure in the system and eliminates the risk of pitching associated with the pressure on the water as it passes through the coil. It is an important feature of the invention that the reservoir can be connected to a number of independent or interconnected radiator circuits by the simple addition or blocking of inlet and outlet tapping combinations. The system thus overcomes reconfiguration or augmentation problems by the relatively simple expedient of allowing additional circuits to be added.

According to one aspect of the invention, the system incorporates a pump controller the controller being operatively connected to the pump and being formed for gradually ramping the pump up to and down from operating speed to enhance system stability. In one arrangement the controller has a large proportional control term.

In another arrangement, the controller incorporates an inverter arrangement to control operating frequency.

According to another aspect of the invention the system incorporates an aperture controller for opening and closing an inlet and or an outlet of a coil of a domestic water cylinder. Beneficially, this enhances system stability and prevents pitching associated with pressure in the coil.

According to a still further aspect of the invention there is provided an emergency vent operable under adverse pressure conditions to vent liquid characterized in that the vent comprises a valve carried on in-line vent housing having a fluid inlet, a fluid outlet and a baffle mounted between the fluid inlet and the fluid outlet.

In one arrangement, the fluid inlet and the fluid outlet are offset.

According to a further aspect of the invention, there is provided a controller for controlling circulation of liquid in a heating system of the type having a plurality of elements characterized in that the controller is configured to increase the circulation path of the liquid only when selected elements have been heated to a desired temperature.

In this way, a heating system with a cylinder and radiator bank can be more effectively heated. The circulation path is initially set from the boiler through the pump and cylinder and back to the boiler. When the returned liquid is sufficiently close to the heated liquid being pumped from the boiler the radiator bank can be included in the circulation loop. This greatly increases the speed at which the system can be brought to a balanced condition, as the inertial effect of individual components is less than that of the overall system with all of the components.

The invention will hereinafter be more particularly described with reference to the accompanying drawings, which show by way of example only, one embodiment of central heating reservoir according to the invention.

Figure 1:
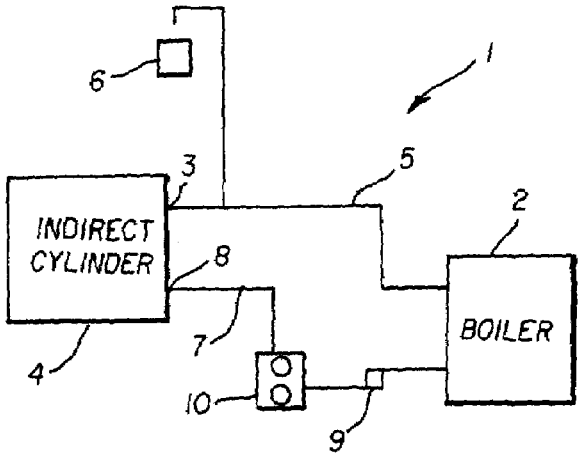
FIG. 1 is a schematic view of a central heating system in accordance with the invention.

Referring to the drawings and initially to FIG. 1 there is shown a central heating system in accordance with the invention indicated generally by the reference numeral 1. The system 1 has a boiler 2 connected to a coil inlet 3 of an indirect cylinder 4 on an outward circuit indicated generally at 5. The outward circuit 5 also has an expansion tank 6. A return circuit indicated generally at 7 connects a coil outlet 8 to the boiler 2 through a pump 9 and a central heating system reservoir 10.

Figure 2:
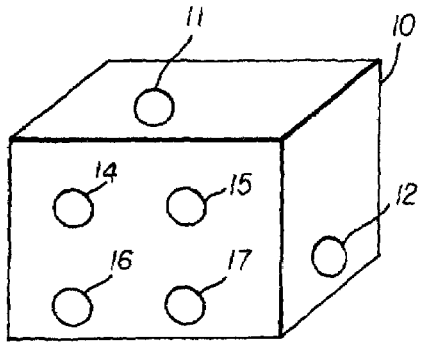
FIG. 2 is a perspective view of a central heating system reservoir forming part of the invention.

In more detail and referring now to FIG. 2 the reservoir 10 has an inlet 11 for receiving water from the cylinder 4 and an outlet 12 for delivering water from the reservoir 10 to the pump 9. The reservoir 10 has two radiator flow tappings 14, 15 and two radiator return tappings 16, 17.

In use, water heated by the boiler 2 is pumped under pressure from the pump 9 on the outward circuit 5 to the inlet 3 and through the cylinder 4. This uses water heated by the central heating system 1 to heat domestic water in the same way as known systems operate. The water then passes through the coil to the outlet 8 and to the reservoir inlet 11. The water in the reservoir 10 is thus heated and cooled water is drawn from the outlet 12 back through the pump 9 to the boiler 2.

The provision of a central heating system reservoir 10 in this way has a number of distinct advantages and technical improvements over known systems. By providing a larger volume of water in the overall system the temperature throughout is balanced, thus eliminating the risk of air being drawn into the system during unnecessary venting occasioned by inaccurate temperature readings. In operation, the system reduces the oxygen content of the water in the system as there air is not drawn in and agitation of water in the system is eliminated. The provision of the central heating system reservoir 10 also reduces pressure in the system and eliminates the risk of pitching associated with the pressure on the water as it passes through the coil of the cylinder 4 between the inlet 3 and the outlet 8.

In the embodiment described the central heating system reservoir 10 draws heated water from each of the radiator flow tappings 14 and 15. This heated water is passed trough a series of radiator circuits (not shown) before being returned to the radiator return tappings 16 and 17 respectively. It is an important feature of the current invention that the reservoir is adaptable for use in conjunction with one or more boilers. This can be achieved by connecting additional tappings to the reservoir. It is also an important feature of the invention that the reservoir incorporates means for connection to a plurality of independent or interconnected radiator circuits by way of inlet and outlet tapping combinations. The system overcomes the reconfiguration or addition problems described by the relatively simple expedient of allowing additional circuits to be added by addition of radiator flow and radiator return tapping combinations.

According to one aspect of the invention, the system incorporates a pump controller (not shown). The controller operates to gradually ramp the pump up to operating speed rather than allowing the impulse associated with full power to throw the system into instability. The controller also operates to reduce the speed in the same way thus improving overall system stability. The controller may optionally use a large proportional control term or an inverter arrangement to control operating frequency.

According to another aspect of the invention the system incorporates an aperture controller for opening and closing the inlet 3 and the outlet 8. This further enhances system stability and prevents pitching associated with pressure in the coil.

By way of an illustrative example of the ability of the system to reduce oxygen from water in the system was conducted and is now described.

Apparatus

The system illustrated in FIG. 1 was filled with 140.8 liters of water.

The working head of the expansion tank was 2.44 meters high.

The distance between the boiler and cylinder was 0.915 meters.

A dissolved Oxygen test on a sample of water from the reservoir on initialisation yielded 5.7 mg/l.

The boiler was then set at a temperature of 65 degrees Celsius and the speed of the pump was reduced the lowest setting.

The system was operated for 27 hours over five days.

| | |
|---|---|
| Day 1 | 3 hrs. |
| Day 2 | 5 hrs. |
| Day 3 | 9½ hrs |
| Day 4 | 5 hrs |
| Day 5 | 4½ hrs |

On day six the dissolved oxygen test was repeated and yielded 1.1 mg/l.

Figure 3:
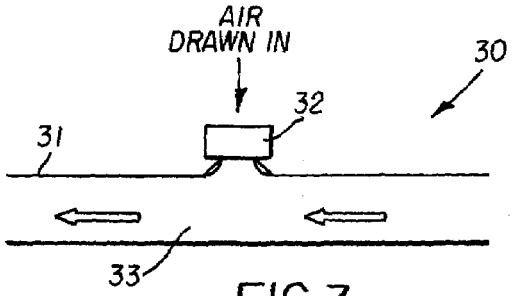
FIG. 3 is an illustrative sectional view of a prior art emergency vent.

Referring now to FIG. 3 there is illustrated a prior art emergency vent indicated generally by the reference numeral 30. In the known arrangement, heating liquid passes through a pipe 31 beneath an emergency valve 32. The manner of mounting the valve 32 on the pipe 31 means that there is an effective constriction on liquid passing through the pipe 31 indicated generally at 33. When the flow rate passing through the constriction 33 is increased there is a resulting reduction in the pressure beneath the valve 32. This effect is referred to as the venturi effect and results in the introduction of air into the system through the valve 32 as indicated with negative impacts on both system effectiveness and operational life.

Figure 4:
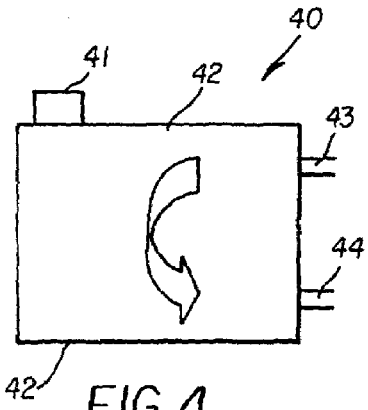
FIG. 4 is an illustrative sectional view similar to that shown in FIG. 3 of an emergency vent forming part of the current invention.

FIG. 4 illustrates an in-line emergency vent forming part of the current invention indicated generally by the reference numeral 40. The emergency vent 40 like the valve 32 of FIG. 3 is operable under adverse pressure conditions to vent liquid from the system. The vent 40 has a valve 41 mounted on an in-line vent housing 42. Additionally, the housing 42 defines a fluid inlet 43 and an offset or non-coaxial fluid outlet 44.

In use, the offset between the inlet 43 and the outlet 44 means that the housing 42 defines a baffle for liquid passing through the housing 42 this baffle means that an increase in circulation rates of the system will not result in the in the ingress of air as there is not effective reduction in pressure associated with the valve 41. By offsetting the liquid inlet 43 from the liquid outlet 44 the flow of liquid there between is disrupted and there is no venturi constriction.

It will of course be understood that the shape of the housing may be altered to minimize any incidental reductions in pressure associated with increased flow and the housing may incorporate one or more baffle plates or similar devices to further disrupt flow and further disassociated reductions in pressure from the valve 41.

The current invention may also incorporate the use of a controller (not shown) for controlling circulation of liquid in a heating system. The controller is configured to increase in stages the circulation path of the liquid. The path of circulating liquid only occurring when selected elements or circulation paths have reached the desired temperature and the system is effectively balanced with the current circuit path. In this way, the momentum of staged heating is improved and a heating system with a cylinder and radiator bank can be more effectively heated. The circulation path is initially set from the boiler through the pump and cylinder and back to the boiler. When the returned liquid is sufficiently close to the heated liquid being pumped from the boiler the radiator bank can be included in the circulation loop. This greatly increases the speed at which the system can be brought to a balanced condition, as the inertial effect of individual components is less than that of the overall system with all of the components.

It will be understood that the invention is not limited to specific details described herein which are given by way of example only and that various modifications and alterations are possible, within the scope of the appended claims, without departing from the scope of the invention.

The invention claimed is:

1. A central heating system comprising:

a boiler;

a cylinder in fluid communication with the boiler; and a pump for circulating fluid between the boiler, the cylinder, and the reservoir; and a central heating reservoir in fluid communication with the cylinder and the boiler, wherein the reservoir has a liquid inlet where liquid enters the reservoir in a top of the reservoir and a liquid outlet where the liquid in the reservoir exits the reservoir in a lower region of the reservoir, such that the liquid passing through the inlet from the cylinder to the reservoir enters downwardly into the reservoir and exits the reservoir through the liquid outlet, and wherein the reservoir includes a plurality of flow tappings and return tappings for a series of radiator circuits, the flow tappings being provided in an upper region of the reservoir and the return tappings being provided in the lower region of the reservoir at substantially the same height within the reservoir as the liquid outlet.

2. A central heating system as claimed in claim 1, wherein the reservoir includes an emergency vent.

3. A central heating system as claimed in claim 1, further including means for operably communicating liquid from the reservoir to the boiler.

4. A central heating reservoir for a central heating system comprising a boiler, a cylinder in fluid communication with the boiler, and where the reservoir is fluidly communicable with the cylinder and the boiler, and a pump for circulating fluid between the boiler, the cylinder, and the reservoir, the reservoir comprising:

a liquid inlet where liquid enters the reservoir in a top of the reservoir;

a liquid outlet where the liquid in the reservoir exits the reservoir in a lower region of the reservoir, such that the liquid passing through the inlet from the cylinder to the reservoir enters downwardly into the reservoir and exits the reservoir through the liquid outlet; and a plurality of flow tappings and return tappings for a series of radiator circuits, wherein the flow tappings are provided in an upper region of the reservoir and the return tappings are provided in the lower region of the reservoir at substantially the same height within the reservoir as the liquid outlet.

5. A reservoir as claimed in claim 4, wherein the reservoir includes an emergency vent.

6. A reservoir as claimed in claim 5, wherein the emergency vent includes a valve carried on an in-line vent housing having a fluid inlet, a fluid outlet, and a baffle mounted between the fluid inlet and the fluid outlet.

7. A reservoir as claimed in claim 6, wherein the fluid inlet and the fluid outlet are offset.

8. A central heating system as claimed in claim 1, wherein the reservoir comprises an in-line reservoir located only on a return circuit from the cylinder to the boiler.

9. A central heating system as claimed in claim 2, wherein the emergency vent includes a valve carried on an in-line vent housing having a fluid inlet, a fluid outlet, and a baffle mounted between the fluid inlet and the fluid outlet.

10. A central heating system as claimed in claim 9, wherein the fluid inlet and the fluid outlet are offset.

11. A reservoir as claimed in claim 4, wherein the reservoir comprises an in-line reservoir adapted to be located only on a return circuit from the cylinder to the boiler.

12. A central heating system as claimed in claim 1, wherein the cylinder is in fluid communication with the boiler such that the liquid in the boiler exits the boiler and enters the cylinder, and the reservoir is in fluid communication with the boiler such that the liquid in the reservoir exits through the liquid outlet and enters the boiler.

13. A reservoir as claimed in claim 4, wherein in the central heating system, the cylinder is in fluid communication with the boiler such that the liquid in the boiler exits the boiler and enters the cylinder, and wherein the reservoir is fluidly communicable with the boiler such that the liquid in the reservoir exits through the liquid outlet and enters the boiler.

* * * * *